US006957550B2

(12) United States Patent
Wyatt et al.

(10) Patent No.: US 6,957,550 B2
(45) Date of Patent: Oct. 25, 2005

(54) METHOD AND APPARATUS FOR EXTRACTING NON-CONDENSABLE GASES IN A COOLING SYSTEM

(75) Inventors: William Gerald Wyatt, Plano, TX (US); Richard M. Weber, Prosper, TX (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 10/440,716

(22) Filed: May 19, 2003

(65) Prior Publication Data

US 2004/0231351 A1 Nov. 25, 2004

(51) Int. Cl.[7] ..... F25B 43/04; F25B 47/00; F23D 23/12; F28D 15/00

(52) U.S. Cl. ..... 62/475; 62/259.2; 62/85; 165/104.33

(58) Field of Search ..... 62/259.2, 475, 62/85; 165/104.27, 104.33

(56) References Cited

U.S. PATENT DOCUMENTS

| | | | | |
|---|---|---|---|---|
| 2,321,964 A | * | 6/1943 | Zieber | 62/195 |
| 3,131,548 A | | 5/1964 | Chubb et al. | |
| 3,174,540 A | | 3/1965 | Dutton | |

(Continued)

FOREIGN PATENT DOCUMENTS

| | | | |
|---|---|---|---|
| DE | GB 1220952 | 3/1968 | H01Q/1/22 |
| EP | 0 243 239 A2 | 4/1987 | H05K/7/20 |
| EP | 02 51 836 A1 | 5/1987 | H01L/23/42 |
| EP | 0 817 263 A2 | 1/1998 | H01L/23/473 |
| EP | 1 143 778 A1 | 3/2001 | H05K/7/20 |
| EP | 1 380 799 A2 | 5/2003 | F25B/23/00 |
| WO | WO 00/65890 | 2/2000 | H05K/7/20 |
| WO | WO 02/23966 A2 | 3/2002 | H05K/7/00 |

OTHER PUBLICATIONS

PCT Notification of Transmittal of The International Search Report or the Declaration dated Sep. 27, 2004 for PCT/US2004/015086.

Dirk Van Orshoven, "*The use of water as a refrigerant—an exploratory investigation*", Thesis at the University of Wisconsin–Madison, XP–002121470 (pp. I, III–XIII, pp. –114) 1991.

Richard Martin Weber, "Method and Apparatus for Cooling with Coolant at a Subambient Pressure," Currently pending 11/058,691, 32 pages, Feb. 15/2005.

EPO Search Report dated Oct. 25, 2004 for Patent No. 03254283.9–2203; Reference No. JL3846.

EPO Search Report dated Nov. 3, 2004 for Patent No. 03254285.4–2301; Reference No. JL3847.

U.S. Appl. No. 10/853,038 filed May 25, 2004 by inventors Richard M. Weber, et al. for "Method and Apparatus for Controlling Cooling with Coolant at a Subambient Pressure", 25 pages of text and 4 drawing sheets.

Yamada et al., "*Subcooled Flow Boiling With Flow Pattern*", USPGPUB 2003/0053298 A1; (pp. 1–3); Mar. 19, 2002.

(Continued)

*Primary Examiner*—William C. Doerrler
(74) *Attorney, Agent, or Firm*—Baker Botts L.L.P.

(57) ABSTRACT

A cooling technique involves: reducing a pressure of a cooling fluid to a subambient pressure at which the cooling fluid has a boiling temperature less than a temperature of a heat-generating structure; bringing the cooling fluid at the subambient pressure into thermal communication with the heat-generating structure, so that the coolant absorbs heat, boils and vaporizes; thereafter removing heat from the coolant so as to condense substantially all of the coolant to a liquid; and thereafter extracting a selected portion of the cooling fluid that has been cooled, the selected portion being a vapor that includes a non-condensable gas.

5 Claims, 1 Drawing Sheet

U.S. PATENT DOCUMENTS

| | | | | | |
|---|---|---|---|---|---|
| 3,371,298 | A | * | 2/1968 | Narbut | 336/57 |
| 3,586,101 | A | | 6/1971 | Richard | 165/101 |
| 3,609,991 | A | * | 10/1971 | Chu et al. | 62/333 |
| 3,756,903 | A | * | 9/1973 | Jones | 165/274 |
| 3,774,677 | A | | 11/1973 | Antonetti et al. | 165/39 |
| 3,989,102 | A | | 11/1976 | Jaster et al. | 165/107 |
| 4,003,213 | A | | 1/1977 | Cox | |
| 4,019,098 | A | | 4/1977 | McCready et al. | 361/385 |
| 4,330,033 | A | * | 5/1982 | Okada et al. | 165/104.27 |
| 4,381,817 | A | | 5/1983 | Brigida et al. | 165/110 |
| 4,495,988 | A | | 1/1985 | Grossman | 165/96 |
| 4,511,376 | A | * | 4/1985 | Coury | 95/256 |
| 4,794,984 | A | | 1/1989 | Lin | 165/133 |
| 4,851,856 | A | | 7/1989 | Altoz | |
| 4,938,280 | A | | 7/1990 | Clark | 165/80.4 |
| 4,945,980 | A | | 8/1990 | Umezawa | 165/101 |
| 4,998,181 | A | | 3/1991 | Haws et al. | 361/385 |
| 5,128,689 | A | | 7/1992 | Wong et al. | |
| 5,148,859 | A | | 9/1992 | Beamer | 165/41 |
| 5,161,610 | A | | 11/1992 | Leidinger | 165/41 |
| 5,168,919 | A | | 12/1992 | Berenholz et al. | |
| 5,239,443 | A | | 8/1993 | Fahey et al. | 361/689 |
| 5,261,246 | A | * | 11/1993 | Blackmon et al. | 62/85 |
| 5,333,677 | A | | 8/1994 | Molivadas | 165/32 |
| 5,493,305 | A | | 2/1996 | Wooldridge et al. | |
| 5,501,082 | A | | 3/1996 | Tachibana et al. | 62/149 |
| 5,515,690 | A | * | 5/1996 | Blackmon et al. | 62/85 |
| 5,818,692 | A | | 10/1998 | Denney, Jr. et al. | 361/699 |
| 5,841,564 | A | | 11/1998 | McDunn et al. | 359/161 |
| 5,910,160 | A | * | 6/1999 | Cakmakci et al. | 62/195 |
| 5,943,211 | A | | 8/1999 | Havey et al. | 361/699 |
| 5,960,861 | A | | 10/1999 | Price et al. | 165/80.03 |
| 6,018,192 | A | | 1/2000 | Root et al. | 257/714 |
| 6,055,154 | A | | 4/2000 | Azar | 361/688 |
| 6,292,364 | B1 | | 9/2001 | Fitzgerald et al. | |
| 6,297,775 | B1 | | 10/2001 | Haws et al. | |
| 6,498,725 | B2 | | 12/2002 | Cole et al. | |
| 6,519,955 | B2 | | 2/2003 | Marsala | 62/119 |
| 6,679,081 | B2 | | 1/2004 | Marsala | 62/259.2 |
| 2003/0053298 | A1 | | 3/2003 | Yamada et al. | 361/728 |

OTHER PUBLICATIONS

Pages 59 and 80 of "*Willis Haviland Carrier Father of Air Conditioning*", Margaret Ingels, Country Life Press—Garden City (1952).

U.S. Appl. No 10/192,891 filed Jul. 11, 2002 by inventor Richard M. Weber for "Method and Apparatus for Cooling with a Coolant at a Subambient Temperature", 21 pages of text and 2 pages of drawings.

U.S. Appl. No. 10/193,571, filed Jul. 11, 2002 by inventors James L. Haws, William Gerald Wyatt, James F. Kviatkofsky and David B. Denniston for "Method and Apparatus for Removing Heat from a Circuit", 33 pages of text and 3 pages drawings.

* cited by examiner

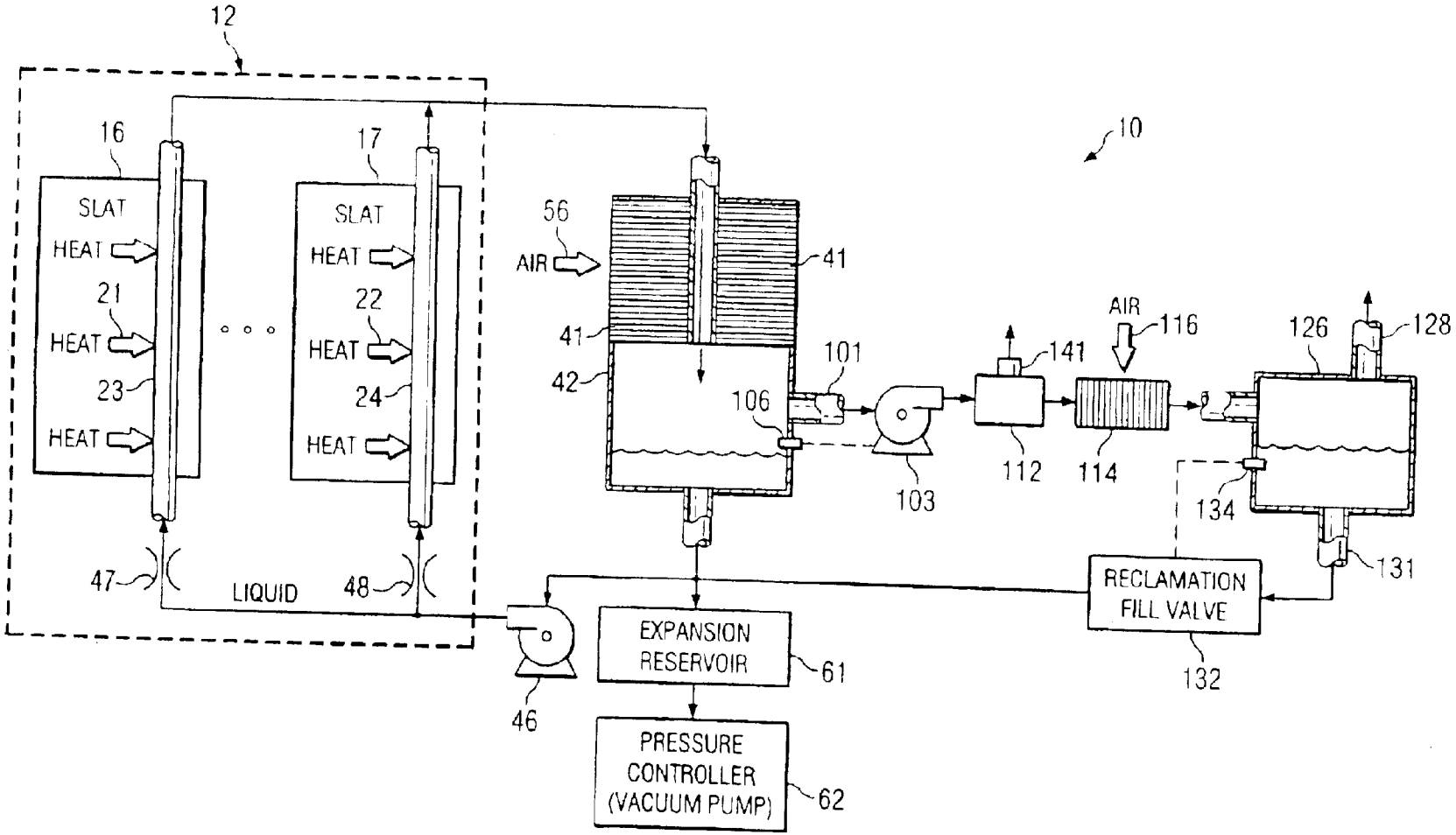
10
12
16
SLAT
HEAT
21
HEAT
23
HEAT
17
SLAT
HEAT
22
HEAT
24
HEAT
47
48
LIQUID
46
56
AIR
41
42
41
101
106
103
112
141
114
AIR
116
126
128
134
131
RECLAMATION FILL VALVE
132
EXPANSION RESERVOIR
61
PRESSURE CONTROLLER (VACUUM PUMP)
62

METHOD AND APPARATUS FOR EXTRACTING NON-CONDENSABLE GASES IN A COOLING SYSTEM

BACKGROUND OF THE INVENTION

Some types of electronic circuits use relatively little power, and produce little heat. Circuits of this type can usually be cooled satisfactorily through a passive approach, such as conduction cooling. In contrast, there are other circuits which consume large amounts of power, and produce large amounts of heat. One example is the circuitry used in a phased array antenna system.

More specifically, a modern phased array antenna system can easily produce 25 to 30 kilowatts of heat, or even more, and thus requires about 25 to 30 kilowatts of cooling. Existing systems for cooling this type of circuitry utilize an active cooling approach, in which a fluid coolant is circulated. Existing cooling systems of this type will leak coolant at potential leakage sites, and leakage of coolant may be cause for the system to be shut down. A more recent approach, which can better handle newer circuitry that produces larger amounts of waste heat, involves a cooling system that uses boiling heat transfer, including a system where the pressure in the coolant loop is below the ambient pressure in order to promote boiling at lower temperatures. One advantage of this latter type of system is that, since the cooling loop is at a subambient pressure, the coolant does not have a tendency to leak out of the loop. Although existing units of this type have been generally adequate for their intended purposes, they have not been satisfactory in all respects.

For example, in the case of a subambient cooling system with a two-phase coolant, the coolant does not tend to leak out of the loop, but gases such as air from the ambient environment that may leak into the loop and become present in the coolant can decrease the cooling capability of the system. Existing systems of this type lack the capability, during system operation, to remove air that has leaked into the system's closed loop so as to ensure full capacity operation while eliminating the need to shut the system down for maintenance.

SUMMARY OF THE INVENTION

From the foregoing, it may be appreciated that a need has arisen for a method and apparatus for efficiently removing undesired gases from the coolant of a cooling system. One form of the invention involves: circulating through a flow loop a cooling fluid which includes a fluid coolant, the flow loop passing through heat-generating structure disposed in an environment having an ambient pressure; reducing a pressure of the cooling fluid at a selected location along the flow loop to a subambient pressure at which the cooling fluid has a boiling temperature less than a temperature of the heat-generating structure; bringing the cooling fluid at the subambient pressure into thermal communication with the heat-generating structure, so that the coolant boils and vaporizes to thereby absorb heat from the heat-generating structure; supplying the cooling fluid from the heat-generating structure to a device which removes heat from the coolant so as to condense substantially all of the coolant to a liquid; and thereafter extracting from the flow loop a selected portion of the cooling fluid that has been cooled by the device, the selected portion being a vapor that includes a non-condensable gas.

BRIEF DESCRIPTION OF THE DRAWINGS

A better understanding of the present invention will be realized from the detailed description which follows, taken in conjunction with the accompanying drawing, which is a block diagram of an apparatus that includes a phased array antenna system, and an associated cooling arrangement which embodies aspects of the present invention.

DETAILED DESCRIPTION

The drawing is a block diagram of an apparatus 10 which includes a phased array antenna system 12. The antenna system 12 includes a plurality of identical modular parts that are commonly known as slats, two of which are depicted at 16 and 17. A feature of the present invention involves techniques for cooling the slats 16 and 17, so as to remove heat generated by electronic circuitry therein.

The electronic circuitry within the antenna system 12 has a known configuration, and is therefore not illustrated and described here in detail. Instead, the circuitry is described only briefly here, to an extent which facilitates an understanding of the present invention. In particular, the antenna system 12 includes a two-dimensional array of not-illustrated antenna elements, each column of the antenna elements being provided on a respective one of the slats, including the slats 16 and 17. Each slat includes separate and not-illustrated transmit/receive circuitry for each antenna element. It is the transmit/receive circuitry which generates most of the heat that needs to be withdrawn from the slats. The heat generated by the transmit/receive circuitry is shown diagrammatically in the drawing, for example by the arrows at 21 and 22.

Each of the slats 16 and 17 is configured so that the heat it generates is transferred to a tube 23 or 24 which extends through that slat. Each of the tubes 23 or 24 could alternatively be a channel or a passageway extending through the associated slat, instead of a physically separate tube. A fluid coolant flows through each of the tubes 23 and 24. As discussed later, this fluid coolant is a two-phase coolant, which enters the slat in liquid form. Absorption of heat from the slat causes part or all of the liquid coolant to boil and vaporize, such that some or all of the coolant leaving the slats 16 and 17 is in its vapor phase. This departing coolant then flows successively through a heat exchanger 41, a collection chamber 42, a pump 46, and a respective one of two orifices 47 and 48, in order to again reach the inlet ends of the tubes 23 and 24. The pump 46 causes the coolant to circulate around this endless loop. In the disclosed embodiment, the pump 46 consumes only about 0.5 kilowatts to 2.0 kilowatts of power.

The orifices 47 and 48 facilitate proper partitioning of the coolant among the respective slats, and also help to create a large pressure drop between the output of the pump 46 and the tubes 23 and 24 in which the coolant vaporizes. It is possible for the orifices 47 and 48 to have the same size, or to have different sizes in order to partition the coolant in a proportional manner which facilities a desired cooling profile.

Ambient air 56 is caused to flow through the heat exchanger 41, for example by a not-illustrated fan of a known type. Alternatively, if the apparatus 10 was on a ship, the flow 56 could be ambient sea water. The heat exchanger 41 transfers heat from the coolant to the air flow 56. The heat exchanger 41 thus cools the coolant, thereby causing most or all of the coolant which is in the vapor phase to condense back into its liquid phase.

The liquid coolant exiting the heat exchanger 41 enters the collection chamber 42. The pump 46 withdraws liquid coolant from the lower portion of the collection chamber 42. An expansion reservoir 61 communicates with the conduit between the collection chamber 42 and the pump 46. The expansion reservoir 61 is in turn coupled to a pressure controller 62. In the disclosed embodiment, the pressure controller 62 is a vacuum pump. Since fluids typically take up more volume in their vapor phase than in their liquid phase, the expansion reservoir 61 is provided in order to take up the volume of liquid coolant that is displaced when some or all of the coolant in the system changes from its liquid phase to its vapor phase. The amount of coolant which is in its vapor phase can vary over time, due in part to the fact that the amount of heat being produced by the antenna system 12 will vary over time, as the antenna system operates in various operational modes.

Typically, the ambient air pressure will be approximately that of atmospheric air, which at sea level is 14.7 pounds per square inch area (psia). In the portion of the cooling loop which is downstream of the orifices 47–48 and upstream of the pump 46, the pressure controller 62 maintains the coolant at a subambient pressure, or in other words a pressure less than the ambient air pressure. In the disclosed embodiment, the pressure controller 62 maintains a subambient pressure within a range of about 2 psia to 8 psia, for example 3 psia.

Turning now in more detail to the coolant, one highly efficient technique for removing heat from a surface is to boil and vaporize a liquid which is in contact with the surface. As the liquid vaporizes, it inherently absorbs heat. The amount of heat that can be absorbed per unit volume of a liquid is commonly known as the latent heat of vaporization of the liquid. The higher the latent heat of vaporization, the larger the amount of heat that can be absorbed per unit volume of liquid being vaporized.

The coolant used in the disclosed embodiment is water. Water absorbs a substantial amount of heat as it vaporizes, and thus has a very high latent heat of vaporization. However, at atmospheric pressure of 14.7 psia, water boils at a temperature of 100° C. In order to provide suitable cooling for an electronic apparatus such as the phased array antenna system 12, the coolant needs to boil at a temperature of approximately 60° C. When water is subjected to a subambient pressure of about 3 psia, its boiling temperature decreases to approximately 60° C. Thus, in the disclosed embodiment, the orifices 47 and 48 permit the coolant pressure downstream from them to be substantially less than the coolant pressure between the pump 46 and the orifices 47 and 48. The pressure controller 62 maintains the water coolant at a pressure of approximately 3 psia along the portion of the loop which extends from the orifices 47 and 48 to the pump 46, in particular through the tubes 23 and 24, the heat exchanger 41, and the collection chamber 42.

Water flowing from the pump 46 to the orifices 47 and 48 has a temperature of approximately 65° C. to 70° C., and a pressure in the range of approximately 15 psia to 100 psia. After passing through the orifices 47 and 48, the water will still have a temperature of approximately 65° C. to 70° C., but will have a much lower pressure, in the range of about 2 psia to 8 psia. Due to this reduced pressure, some or all of the water will boil as it passes through and absorbs heat from the tubes 23 and 24, and some or all of the water will thus vaporize. After exiting the slats 16 and 17, the water vapor (and any remaining liquid water) will still have the reduced pressure of about 2 psia to 8 psia, but will have an increased temperature in the range of approximately 70° C. to 75° C.

When this subambient coolant water reaches the heat exchanger 41, heat will be transferred from the water to the forced air flow 56. The air flow 56 has a temperature less than a specified maximum of 55° C., and typically has an ambient temperature below about 40° C. As heat is removed from the water coolant, any portion of the water which is in its vapor phase will condense, such that all of the coolant water will be in liquid form when it exits the heat exchanger 41 and enters the collection chamber 42. This liquid will have a temperature of approximately 65° C. to 70° C., and will still be at the subambient pressure of approximately 2 psia to 8 psia. This liquid coolant will then flow through the pump 46, and the pump will have the effect of increasing the pressure of the coolant water, to a value in the range of approximately 15 psia to 100 psia, as mentioned earlier.

As mentioned above, the coolant used in the disclosed embodiment is water. However, it would alternatively be possible to use any of a variety of other coolants, including but not limited to methanol, a fluorinert, a mixture of water and methanol, or a mixture of water and ethylene glycol (WEGL). These alternative coolants each have a latent heat of vaporization less than that of water, which means that a larger volume of coolant must be flowing in order to obtain the same cooling effect that can be obtained with water. As one example, a fluorinert has a latent heat of vaporization which is typically about 5% of the latent heat of vaporization of water. Thus, in order for a fluorinert to achieve the same cooling effect as a given volume or flow rate of water, the volume or flow rate of the fluorinert would have to be approximately twenty times the given volume or flow rate of water.

Despite the fact that these alternative coolants have a lower latent heat of vaporization than water, there are some applications where use of one of these other coolants can be advantageous, depending on various factors, including the amount of heat which needs to be dissipated. As one example, in an application where a pure water coolant may be subjected to low temperatures that might cause it to freeze when not in use, a mixture of water and ethylene glycol (WEGL) could be a more suitable coolant than pure water, even though the WEGL mixture has a latent heat of vaporization which is lower than that of pure water.

Theoretically, the cooling loop discussed above should contain only coolant. As a practical matter, however, non-condensable gases such as external air may possibly leak into the cooling loop. Non-condensable gases can also originate from dissolved gases in the initial charge of liquid coolant, or in additional quantities of coolant added to the system from time to time to make up for coolant lost during normal operation. To the extent that non-condensable gases such as air accumulate within the system, they can significantly decrease the heat removal capability. Accordingly, the disclosed embodiment includes a reclamation section which is configured to remove non-condensable gases from the coolant. In more detail, the collection chamber 42 has an outlet 101 which is disposed above the highest permissible level for the liquid coolant within the chamber 42. The outlet 101 is coupled to a pump 103, which is selectively actuated and deactuated by a level switch 106.

The level switch 106 is disposed in the collection chamber 42 at approximately the level of the top surface of the liquid coolant in the lower portion of the chamber 42. To the extent that non-condensable gases such as air may progressively leak into the system over time, they will take up a progressively increasing amount of room in the upper portion of the chamber 42. As a result, the level of the liquid coolant in the lower portion of the collection chamber 42 will decrease, because the increasing amount of non-condensable gases will force some liquid coolant into the expansion reservoir 61. When the top surface of the liquid coolant in the collection chamber 42 drops below the level switch 106, the level switch 106 will activate the pump 103. The pump 103 then withdraws a mixture of coolant vapor and non-condensable gases from the upper portion of the collection chamber 42, while increasing the pressure of this mixture until it is higher than the ambient pressure.

The mixture of coolant and non-condensable gases from the pump 103 then pass through a bypass valve 112, which is discussed in more detail later, to an auxiliary heat exchanger 114. Ambient air is caused to flow at 116 through the heat exchanger 114, for example by a not-illustrated fan of a known type. Alternatively, if the apparatus 10 was on a ship, the flow 116 could be ambient sea water. The heat exchanger 114 transfers heat to the air flow 116 from the mixture of coolant and non-condensable gases, in order to condense substantially all coolant vapor in the mixture into liquid form, such that only the non-condensable gases remain.

From the heat exchanger 14, the vapor and liquid flow into a collection tank 126. The tank 126 has a vent 128, which provides fluid communication between the ambient environment and the upper portion of the tank. Due to the heat exchanger 14, virtually all of the coolant will be in liquid form. Consequently, non-condensable gases such as air will exit the collection tank 126 through the vent 128, but little or no coolant will be lost through the vent 128. The gases exiting through the vent 128 will be saturated at the temperature of the tank 126, which in turn will determine the required amount of make-up coolant needed for the system.

The tank 126 also has an outlet 131 in a lower portion thereof, and the outlet 131 communicates through a reclamation fill valve 132 with the inlet to the pump 46. The valve 132 is controlled by a level switch 134, which is sensitive to the level of the liquid coolant within the tank 126. When the top surface of the liquid coolant is respectively above and below the level switch 134, the level switch 134 respectively opens and closes the valve 132. As evident from the foregoing discussion, the pressure in the tank 126 is at or above ambient air pressure, and the pressure controller 62 maintains a subambient pressure at the inlet to the pump 46. Consequently, when the valve 132 is open, the pressure differential on opposite sides of the valve 132 causes liquid coolant to readily flow from the tank 126 to the pump 46. When the level of the top surface of the liquid coolant in the tank 126 drops below the level switch 134, the level switch 134 closes the valve 132.

Turning now in more detail to the bypass valve 112, the bypass valve 112 can be selectively operated in either of two operational modes. In one operational mode, the bypass valve 112 takes the mixture of coolant and non-condensable gases which it receives from the pump 103 and supplies this mixture to the heat exchanger 114, in the manner discussed above. In the other mode of operation, the valve 112 takes the mixture which it receives from the pump 103 and supplies this mixture to a vent 141 that communicates with the ambient environment, such that all of the mixture is exhausted directly to the ambient environment, and none of the mixture reaches the heat exchanger 114. The non-condensable gases in the collection chamber 42 are at 100% relative humidity, or in other words are saturated with respect to the coolant vapor. Where the ambient environment is humid, for example at 95% relative humidity, setting the bypass valve 112 to use the vent 141 results in a situation where the air leaking into the system is at 95% humidity, and the air expelled through the vent 141 is at 100% humidity. The difference of 5% relative humidity represents a very small volume of water being lost. There may be circumstances in which it is desirable to accept this relatively low rate of coolant loss, for example to permit use of the system even where the heat exchanger 114, the level switch 134, or the valve 132 is broken.

In the disclosed embodiment, there is a not-illustrated sight glass, which is a vertical glass tube that is in fluid communication with the flow loop for the coolant. By looking at the level of coolant within the sight glass, a determination can be made of the extent to which the amount of coolant in the system has decreased, for example through loss of small amounts of coolant vapor through the vent 128 or the vent 141. More liquid coolant can then be added to the system. Alternatively, it would be possible to calculate the required amount of make-up coolant with the aid of a psychometric chart, and with knowledge of the flow rate and temperature of the vapor-saturated gases leaving the tank 126 through the vent 128. The provision of the heat exchanger 114 helps to convert as much of the coolant as possible to liquid form, thereby minimizing the amount of coolant lost through the vent 128, which in turn reduces the amount of coolant which must be periodically added to replace lost coolant.

The present invention provides a number of advantages. One such advantage is that non-condensable gases are removed from the coolant, through highly efficient separation of the non-condensable gases and the coolant, so as to avoid significant loss of coolant. This in turn reduces the amount of replacement coolant which must be periodically added to the system. Further, the efficient removal of the non-condensable gases ensures that the system continues to provide an optimum heat removal capability.

Although one embodiment has been illustrated and described in detail, it will be understood that various substitutions and alterations are possible without departing from the spirit and scope of the present invention, as defined by the following claims.

What is claimed is:

1. A method, comprising:

circulating through a flow loop a cooling fluid which includes a fluid coolant, said flow loop passing through heat-generating structure disposed in an environment having an ambient pressure, said fluid coolant having a boiling temperature in the range of 60° C. to 75° C. at at least one pressure in the range of two to eight psia;

reducing a pressure of said cooling fluid at a selected location along said flow loop to a subambient pressure at which said cooling fluid has a boiling temperature less than a temperature of said heat-generating structure;

bringing said cooling fluid at said subambient pressure into thermal communication with said heat-generating structure, so that said coolant boils and vaporizes to thereby absorb heat from said heat-generating structure;

supplying said cooling fluid from said heat-generating structure to a device which removes heat from said coolant so as to condense substantially all of said coolant to a liquid;

thereafter extracting from said flow loop a selected portion of said cooling fluid that has been cooled by said device, said selected portion being a vapor that includes a non-condensable gas; and wherein said selected portion includes some vapor of said coolant, and including:

increasing a pressure of said selected portion to a selected pressure higher than said subambient pressure;

supplying said selected portion at said selected pressure to a heat exchanger which removes heat from said selected portion to condense to a liquid substantially all of said vapor of said coolant which is present in said selected portion;

thereafter separating said non-condensable gas of said selected portion from said liquid coolant of said selected portion;

discharging to said environment said non-condensable gas separated from liquid coolant of said selected portion; and returning said liquid coolant of said selected portion to said flow loop.

2. A method according to claim 1, including discharging said selected portion to said environment.

3. An apparatus, comprising:

heat-generating structure disposed in an environment having an ambient pressure;

a first portion defining a flow loop which passes through said heat-generating structure, said flow loop having a cooling fluid circulating therethrough, and said cooling fluid including a fluid coolant;

a second portion which reduces a pressure of said cooling fluid at a selected location along said flow loop to a subambient pressure at which said cooling fluid has a boiling temperature less than a temperature of said heat-generating structure, said cooling fluid at said subambient pressure moving along said flow loop into thermal communication with said heat-generating structure, so that said coolant boils and vaporizes to thereby absorb heat from said heat-generating structure;

a third portion along said flow loop which receives said cooling fluid from said heat-generating structure and which removes heat from said coolant so as to condense substantially all of said coolant to a liquid; and a fourth portion which extracts from said flow loop a selected portion of said cooling fluid that has been cooled, said selected portion being a vapor that includes a non-condensable gas;

wherein said selected portion includes some vapor of said coolant, and including:

a fifth portion which increases a pressure of said selected portion to a selected pressure higher than said subambient pressure;

a heat exchanger which receives said selected portion at said selected pressure and which removes heat from said selected portion to condense to a liquid substantially all of said vapor of said coolant which is present in said selected portion;

a sixth portion which separates said non-condensable gas of said selected portion from said liquid coolant of said selected portion;

a seventh portion which discharges to said environment said non-condensable gas separated from liquid coolant of said selected portion;

an eighth portion for thereafter returning to said flow loop said liquid coolant of said selected portion; and including between said fourth and fifth portions a valve which is selectively operable in first and second operational modes, wherein in said first operational mode said valve discharges said selected portion from said fourth portion to said environment, and wherein in said second operational mode said valve supplies said selected portion from said fourth portion to said fifth portion.

4. An apparatus according to claim 3, wherein said seventh portion includes a chamber which recites said liquid coolant, and which has an opening that provides fluid communication between an interior of said chamber and said environment.

5. An apparatus according to claim 4, wherein said eighth portion includes a valve, and includes a level switch coupled to said valve and responsive to a level of said liquid coolant in said chamber for selectively actuating said valve.

* * * * *